US007237419B2

(12) United States Patent
Fielder et al.

(10) Patent No.: US 7,237,419 B2
(45) Date of Patent: Jul. 3, 2007

(54) BENDING MACHINE

(75) Inventors: Glenn Fielder, Berlin (DE); Ivo Karrasch, Berlin (DE)

(73) Assignee: Trumpf Maschinen Austria GesmvH & Co KG (DE)

( * ) Notice: Subject to any disclaimer, the term of this patent is extended or adjusted under 35 U.S.C. 154(b) by 80 days.

(21) Appl. No.: 11/099,867

(22) Filed: Apr. 5, 2005

(65) Prior Publication Data

US 2005/0217342 A1 Oct. 6, 2005

(30) Foreign Application Priority Data

Apr. 6, 2004 (EP) ..... 04008272

(51) Int. Cl.
*B21D 5/04* (2006.01)

(52) U.S. Cl. ..... 72/315; 72/309

(58) Field of Classification Search ..... 72/312–315, 72/308, 309, 319, 322
See application file for complete search history.

(56) References Cited

U.S. PATENT DOCUMENTS 4,520,646 A * 6/1985 Pauzin ..... 72/313
2002/0152789 A1 10/2002 Matsuoka

FOREIGN PATENT DOCUMENTS

| | | | |
|---|---|---|---|
| EP | 0 610 706 A1 | | 8/1994 |
| JP | 59-33032 | | 2/1984 |
| JP | 5-261441 | * | 10/1993 |
| JP | 6-31342 | * | 2/1994 |
| WO | WO 96/24445 | | 8/1996 |

* cited by examiner

*Primary Examiner*—Daniel C. Crane

(57) ABSTRACT

A bending tool (12) for bending workpieces, especially plate and sheet metal blanks includes at least one bending element (23) positioned on one side of a workpiece as well as a retainer device with clamping elements (14, 42) on opposite sides of the workpiece. For bending the workpiece, the retainer is moved, together with the workpiece clamped on it, relative to a bending element (23). In the process, the retainer device with the workpiece and the bending element (23) move relative to each other in a bending stroke which contains a component in the bending-stroke direction as well as a component in the transverse direction of the bending stroke. The direction of the bending stroke is controlled by at least one control element associated with the bending element (23) as well as at least one guide element associated with the equal-sided clamping element (42). The last-mentioned guide element or elements can move in the bending-stroke direction (8) relative to the first-mentioned control element or elements (46).

11 Claims, 4 Drawing Sheets

BENDING MACHINE

BACKGROUND OF THE INVENTION

This invention relates to a bending tool for bending workpieces, especially plate and sheet metal blanks, along a bending line, with at least one bending element positioned on one side of the workpiece and with at least one retaining device featuring clamping elements on mutually opposite sides in the transverse direction of the workpiece so that a relative movement of the clamping elements on both sides in the transverse direction of the workpiece permits the workpiece to be clamped down on the retaining device, while the retaining device with the clamped-on workpiece and a bending element can be moved toward each other in a bending stroke that bends the workpiece. This bending stroke includes a component in the bending-stroke direction extending in the transverse direction of the workpiece as well as a component in the cross stroke direction that extends transversely relative to the plane bounded by the direction of the bending line and the bending-stroke direction, the directional movement of the bending stroke being controlled by means of a motion control system that encompasses at least one control element associated and moving with a bending element as well as at least one guide element associated with a bending element. This invention also relates to a bending machine that is equipped with at least one such bending tool.

A bending tool and a bending machine of the type referred to above have been described in JP 59 033032 A. This earlier bending tool includes an upper tool section positioned above the workpiece to be processed as well as a lower tool section positioned underneath the workpiece to be processed. The upper tool section encompasses a spring-loaded retaining plate which in its home position extends in the transverse direction of the workpiece, and, to the side of that plate, a bending tool.

The bending tool can be rotated around a pivot that extends parallel to the bending line along the workpiece that is to be bent and is provided with a control surface that is sloped in the transverse direction of the workpiece. The lower tool section consists essentially of a support block positioned opposite the retaining plate of the upper tool section, as well as a control block positioned to the side of and at a distance from the support block. On its side facing the bending tool of the upper tool section, the control block on its part features a sloped control surface. A metal blank to be processed is placed on the support block of the lower tool section. Next, the upper tool section is lowered toward the lower tool section in the transverse direction of the workpiece. This causes the retaining plate of the upper tool section to make contact with the surface of the metal blank facing it. The blank is thus clamped between the retaining plate of the upper tool section and the support block of the lower tool section. As the downward movement of the upper tool section continues, the retaining plate remains firmly in place. The bending tool of the upper tool section, however, continues to move in the direction of the lower tool section. As a result, the forming edge of the bending tool strikes the rim of the blank laterally protruding between the retaining plate of the upper tool section and the support block of the lower tool section. At the same time the control surface of the bending tool makes contact with the control surface of the control block on the lower tool section. As they come together, the two control surfaces cause the downwardly moving bending tool to rotate around its pivot. The overall result is a bending stroke of the bending punch with a component in the transverse direction of the workpiece and a component parallel to the workpiece.

It is the objective of this invention to provide a novel bending tool design that simplifies the prior art construction described above.

SUMMARY OF THE INVENTION

It has now been found that the foregoing and related object may be readily attained in a bending tool for bending sheet metal and plate workpieces along a bending line, has at least one bending element positioned on one side of the workpiece and at least one retaining device featuring clamping elements on mutually opposite sides in the transverse direction of the workpiece. Relative movement of the clamping elements in the transverse direction of the workpiece permits the workpiece to be clamped to the retaining device while the retaining device with the clamped-down workpiece and a bending element can be moved toward each other in a bending stroke that bends the workpiece. The bending stroke includes a component in a stroke direction extending in a transverse direction of the workpiece as well as a component in the cross stroke direction that extends transversely relative to the plane bounded by the direction of the bending line and the stroke direction. The directional movement of the bending stroke is controlled by a motion control system that includes at least one guide element associated and moving with the retaining device as well as at least one control element associated with a bending element. A guide element associated with the retaining device is provided on the side of the workpiece for contact with a bending element and the guide element is linked to a clamping element positioned on the same side of the workpiece of the retaining device, so that, during a bending stroke, the retaining device with a clamping element and an associated guide element can be moved relative to the bending element and an associated control element in the bending-stroke direction.

Most desirably the clamping element is equal sided, and the bending element and an associated control element are supported on a tool base in the bending-stroke direction. The retaining device with a clamping element and an associated guide element can be moved relative to the bending element and its associated control element, supported on the tool base, in the bending-stroke direction.

Preferably, an equal-sided clamping element and an associated guide element are guided on the tool base in the bending-stroke direction. The equal-sided clamping element holds the workpiece in the bending-stroke direction and is movably supported on the tool base in the bending-stroke direction jointly with an associated guide element by a device for generating a restoring force and at least one clamping element of the retaining device bears on the workpiece on its opposite side in the bending-stroke direction. Desirably, the device provided for generating a restoring force is a pneumatic spring.

The tool desirably has a unitary assembly of an equal-sided clamping element with an associated guide element, and the support for a bending element and its associated control element is adjustable in its position on the tool base. The support of a bending element and its associated control element on the tool base encompasses a plummer block on which the bending element and its associated control element are seated and which is positionally adjustable in a mount on the tool base. Preferably, the bending element is provided in the form of a swivel lever which, in combination with an associated control element, is supported on the tool base in the bending-stroke direction and which, seated on a swivel mount with a pivot that extends in the direction of the bending line, can be moved transversely relative to the direction of the bending stroke.

In the design according to this invention, the control elements for the directional control of the bending stroke between the workpiece being processed and a bending element provided for processing the workpiece are positioned on one and the same side of the workpiece. The result is a structurally compact overall system. This permits the implementation of the novel feature of this invention whereby, in the aforementioned bending stroke, the retaining device holding the workpiece and a control element associated with the retaining device move in the direction of the stroke relative to a bending element and a control element linked to and traveling with it. Thus, according to the invention, the bending stroke is generated in that the travel of the retaining device along one axis is also utilized to clamp the workpiece being processed onto the retaining device. This obviates the need for structural means that move the bending element relative to the workpiece to be processed.

The bending tool has a tool base that supports in the direction of the bending stroke at least one bending element and, associated with it, a control element, and an equal-sided clamping element and an associated control element can be moved in the direction of the bending stroke relative to the base.

The preferred configuration provides for the automatic, joint resetting of the clamping element and associated control element into their home position following a completed bending stroke.

The resetting of the clamping element and associated control element is accomplished by means of a pneumatic spring. According to the invention the use of such a gas-pressure spring makes it possible with a relatively small machine component to strike the workpiece with considerable force in the direction of the clamping element or elements positioned on the opposite side of the workpiece, thus applying a particularly high clamping force on the workpiece.

The equal-sided clamping element and an associated control element constitute components of a modular unit. The modular implementation of that clamping element with its associated control element permits easy assembly and disassembly of the bending tool according to the invention. For example, if suitably designed, the clamping element and its associated control element can be jointly detached from the tool base, should it become necessary. The bending element and its control element will thus be accessible with very little effort.

In the preferred configuration of the bending tool the support of at least one bending element and its associated control element is positionally adjustable. The adjustability can serve for instance to compensate for assembly and/or manufacturing tolerances on the bending tool. Particularly significant is the adjustability of the bending element in cases where several bending tools in accordance with this invention are juxtapositioned and are operated jointly. An appropriate adjustment allows the bending elements of the individual bending tools to be positioned as needed in relation to one another.

In another preferred design concept, a bending element is configured as a swivel lever that is supported on the tool base in the direction of the bending stroke while being movable in the transverse direction of the bending stroke by means of a pivot bearing.

The tool holders in the machine base of a conventional bending press accommodate at least one bending tool. One of the tool holders is provided with at least one bending element, at least one equal-sided clamping element and at least one control element associated with the bending element and the equal-sided clamping element. The tool holder on the opposite side of the workpiece holds at least one clamping element of the retaining device. The relative movement of the workpiece necessary for the processing of the workpiece and, respectively, of at least one bending element is generated by the usual relative motion of the tool holders on the bending press. As an alternative to the preferred bending tools made according to the invention, conventional bending tools can be interchangeably mounted in the tool holders of the machine base, thus permitting variable utilization of the machine base.

BRIEF DESCRIPTION OF THE DRAWINGS

The following will explain this invention in more detail with the aid of schematic illustrations of a design example in which.

DETAILED DESCRIPTION OF THE PREFERRED EMBODIMENT

Figure 1:
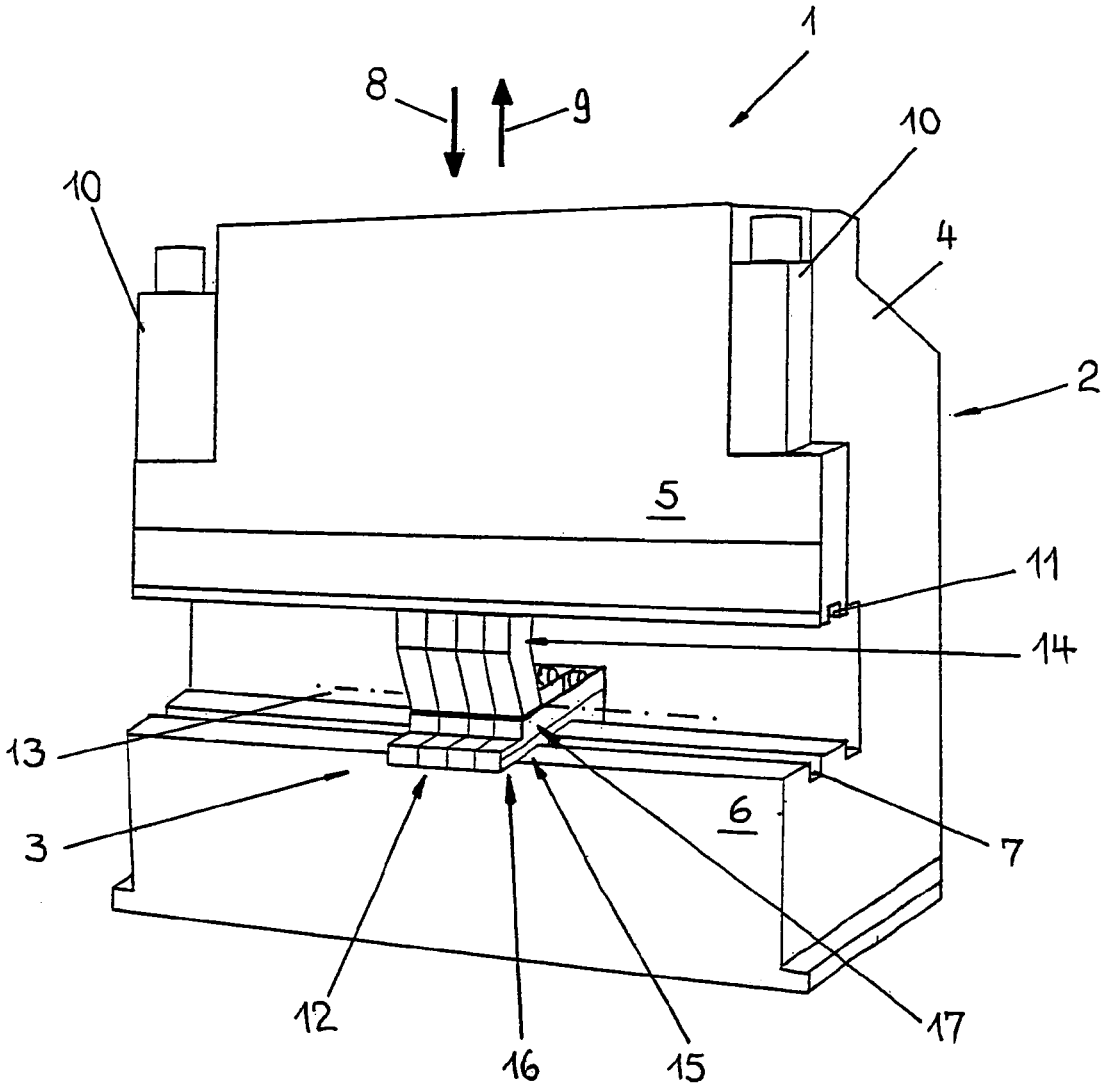
FIG. 1 is a diagrammatic illustration of a bending machine with a processing station composed of several bending tools.

As shown in FIG. 1, a bending machine 1 employs as a machine base 2 the machine base of a conventional bending press and is additionally equipped with a processing station 3. In traditional fashion, the machine base 2 encompasses a machine frame 4 as well as a crosshead beam 5. The machine frame 4 forms a support table 6 with a lower tool holder 7. The crosshead beam 5 is movably guided on the machine frame 4 in a bending-stroke direction 8 and a return-stroke direction 9. The crosshead beam 5 is driven by hydraulic piston-cylinder units 10. On its side facing the support table 6, the crosshead beam 5 is provided with an upper tool holder 11.

The lower tool holder 7 and the upper tool holder 11 will accept the conventional lower and upper tools of bending presses. In the example illustrated, however, the tool holders 7, 11 of the bending machine 1 provide the processing station 3 which, as shown in FIG. 1, is composed of a total of four bending tools 12. Along a bending line 13, indicated in FIG. 1 by a dot-dash line, the bending tools 12 are lined up in contiguous fashion. By adding or removing one or several of the bending tools 12, it is possible to vary the overall width of the processing station 3 and thus the maximum bending length.

Each of the bending tools 12 includes an upper tool in the form of a hold-down 14 as well as a lower tool 15 which includes a tool base 16 and an upper section 17. The hold-downs 14 of the bending tools 12 are seated in the upper tool holder 11 of the crosshead beam 5, and the lower tools 15 are seated in the lower tool holder 7 of the support table 6.

Alternatively, if the tool holders are suitably designed, the hold-downs 14 of the bending tools 12 can be mounted in the lower tool holder 14 and the lower tools 15, now serving as upper tools, can be mounted in the upper tool holder 11.

Figure 3:
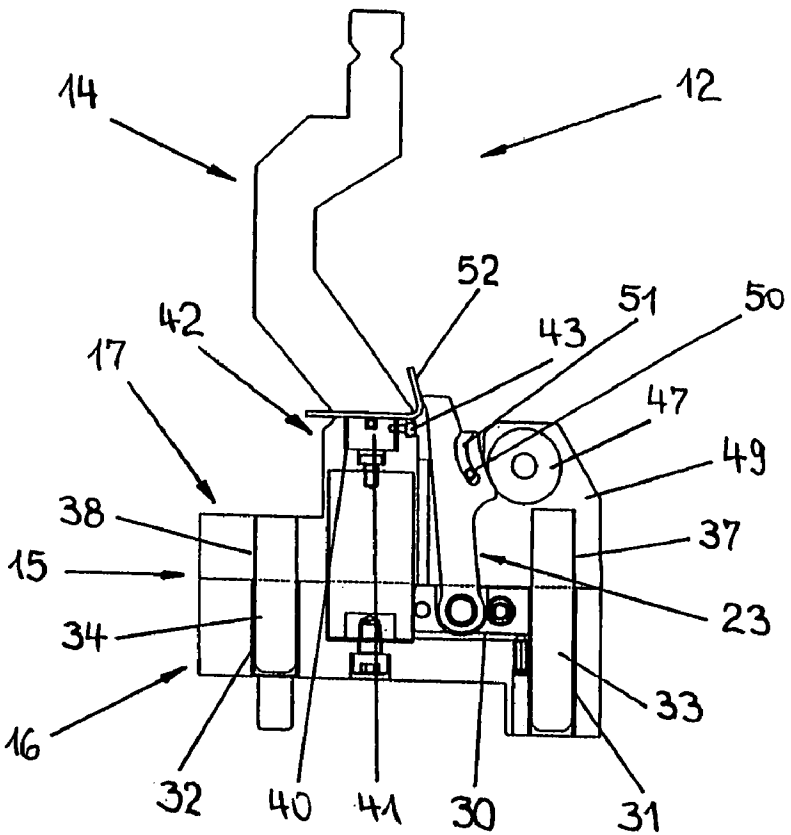
FIGS. 2 and 3 are sectional views of the bending tool of FIG. 1 in various workpiece processing stages.
Figure 2:
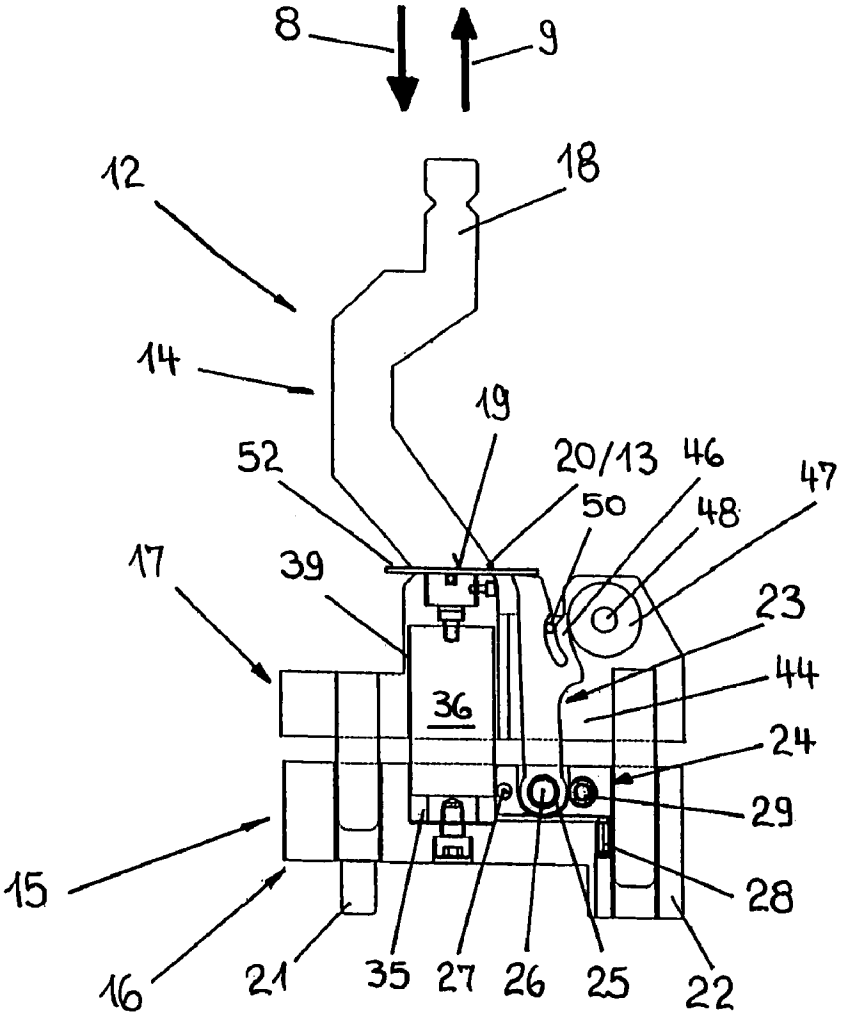

The specific structural configuration of the bending tools 12 will be evident especially from FIGS. 2 and 3.

As shown, the hold-down 14 of a bending tool 12 extends with a projection relative to the vertical line. At its end facing away from the lower tool 15, the hold-down 14 is provided with a mounting flange 18 by means of which it is retained in the upper tool holder 11 on the crosshead beam 5 of the bending machine 1. At its end on the side of the lower tool, the hold-down 14 is provided with a contact surface 19. At the bend 20, the contact surface 19 transitions into a horizontal surface of the hold-down 14.

The lower tool 15 of each bending tool 12 rests with its tool base 16 on the support table 6 of the machine frame 4 of the bending machine 1. A lug 21 on the tool base 16 engages in the lower tool holder 7 of the support table 6. At the same time a protruding catch 22 on the tool base 16 extends around the side of the support table 6. The lug 21 locks the tool base 16 in the lower tool holder 7.

In the bending stroke direction 8 and return-stroke direction 9, the tool base 16 supports a bending element in the form of a swivel lever 23. The support seat for the swivel lever 23 is a plummer block 24 on which the swivel lever 23 is mounted in a manner permitting its rotation around a fulcrum pin 26 in the form of a journal 25. The plummer block 24 is mounted on the tool base 16 and is capable of rotating around a pivot 27. For the rotary movement of the plummer block 24 around the pivot 27, the position of the plummer block 24 can be adjusted by means of a set screw 28. A lock screw 29 secures the plummer block 24 in the selected position.

Apart from the receptacle 30 for the plummer block 24, and facing toward the upper section 17, the tool base 16 is provided with seats 31, 32 for accepting the guide posts 33, 34 as well as a seat 35 for the pneumatic spring 36.

With their longitudinal sections positioned outside the seats 31, 32, the guide posts 33, 34 engage in recesses 37, 38 in the upper section 17 of the lower tool 15. The upper section 17 of the lower tool 15 is provided with a recess that accepts the pneumatic spring 36.

The recess 39 for the pneumatic spring 36 is located on the upper section 17 of the lower tool 15 underneath a groove 40. The groove 40 accepts a support element 41 of a workpiece support 42 of the upper section 17. Manually operated fasteners 43 retain the support element 41 in the groove 40.

The swivel lever 23 extends through the upper section 17 of the lower tool 15 in the bore 44. Within that bore 44, the swivel lever 23 can be rotated around the fulcrum pin 26 within a limited angle of rotation, thus permitting movement in the transverse direction of the bending stroke, i.e. perpendicular to the plane established by the direction of the bending line 13 and the bending-stroke direction 8 or return-stroke direction 9. Protruding from the swivel lever 23 is a control element in the form of a cam gate 46. Associated with the cam gate 46 on the swivel lever 23 in the upper section 17 of the lower tool 15 is a cam-gate guide which, on its part, serves as a control element and consists of a guide roller 47 and a guide pin 50.

Figure 8:
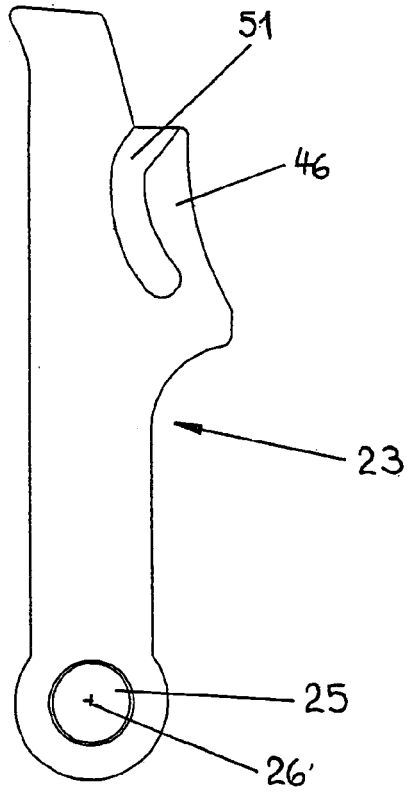
FIG. 8 shows the bending element, in the form of a swivel lever, for the bending tool of FIGS. 1 to 7.

The guide roller 47, which is rotatable around a pivot 48, is supported by a base 49 on the upper section 17. The base 49 also holds the guide pin 50 that engages in a guide slot 51 on the swivel lever 23. FIG. 8 shows in an enlarged view the physical details of the swivel lever 23.

The progression of the processing of a strip of sheet metal 52 by means of a bending tool 12 is shown in FIGS. 2 to 7.

Before the processing of the workpiece is started, the crosshead beam 5 is raised relative to the support table 6 of the bending machine 1 so as to create a space between the free end of the hold-down 14 on the crosshead beam 5 and the upper section 17 of the lower tool 15 or, more specifically, the workpiece support 42. The flat metal strip 52 is inserted in that space. The depth to which it is inserted determines the ultimate location of the bend. The flat metal strip 52 rests on the workpiece support 42.

Figure 4:
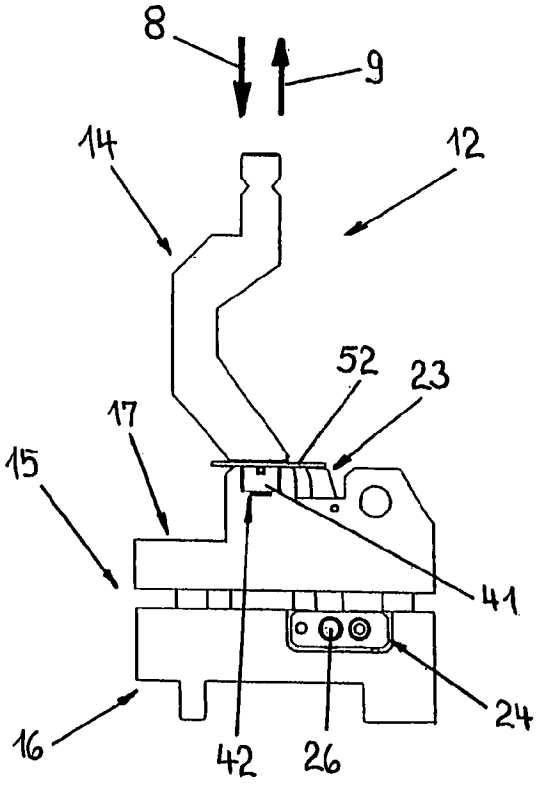
Figure 7:
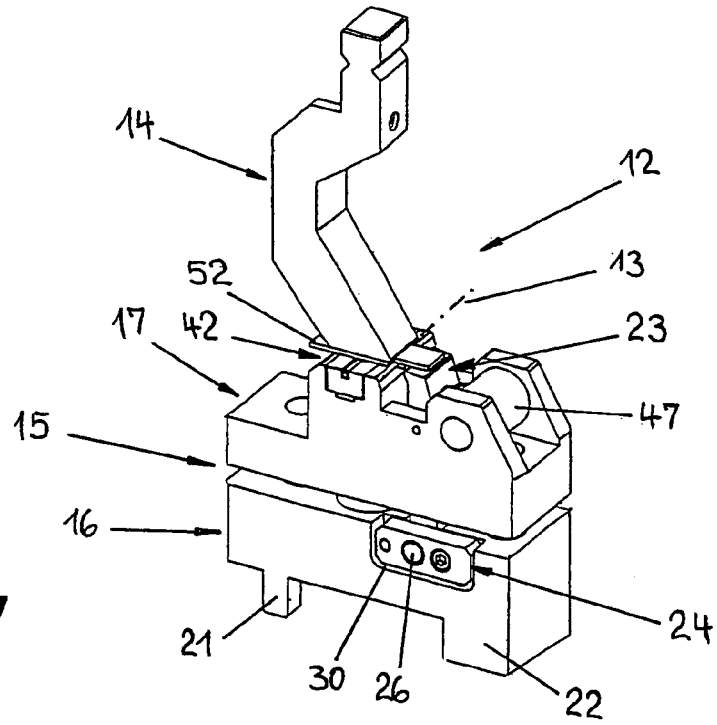
FIG. 7 is a perspective view of a bending tool of FIGS. 1 and 4.

When the hydraulic piston-cylinder system 10 lowers the crosshead beam 5 of the bending machine 1, the hold-down 14 of the bending tool 12 makes contact with the upper surface of the metal strip 52 facing it, creating the operating state condition illustrated in FIGS. 2, 4 and 7. In that operating state, the upper section 17 of the lower tool 15 is in its home position relative to the tool base 16 in the stroke direction 8 and return-stroke direction 9. In that direction the upper section 17 is positioned at a distance from the tool base 16. The upper section 17 is supported on the tool base 16 under the action of the pneumatic spring 36. The swivel lever 23 is aligned in an essentially vertical position. The metal strip 52 is clamped under low pressure between the hold-down 14 and the workpiece support 42 on the upper section 17 of the lower tool 15

When, through an appropriate movement of the crosshead beam 5 of the bending machine 1, the hold-down 14 is lowered further in the bending-stroke direction 8, the pneumatic spring 36 will exert a relatively high counterpressure. This counterpressure reinforces the clamping of the metal strip 52 between the hold-down 14 and the workpiece support 42 of the upper section 17 of the lower tool 15 which is lowered in unison with the hold-down 14. The hold-down 14 and the workpiece support 42 thus perform the function of clamping elements for locking the metal strip 52 in place. The holding power acting on the metal strip 52 is further increased by a friction-enhancing coating on the support element 41 of the workpiece support 42 on which rests the metal strip 52.

Figure 5:
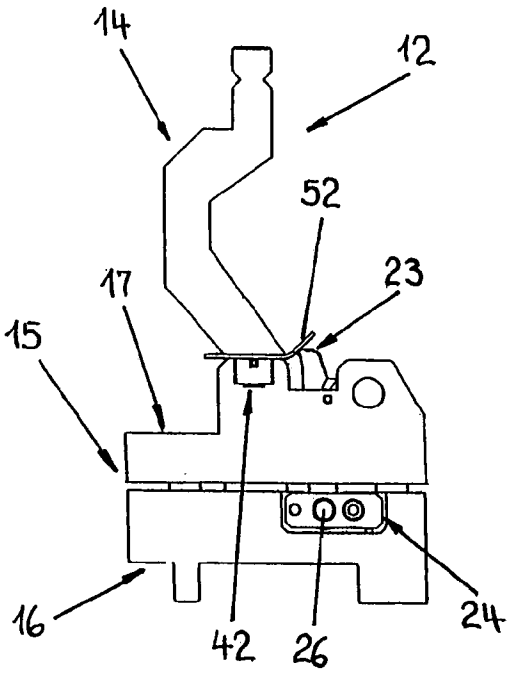

Structurally interacting with the workpiece support 42, the guide roller 47 and the guide pin 50 on the upper section 17 of the lower tool 15 descend in the bending-stroke direction 8. The support pressure on the swivel lever 23 on the tool base 16 exerted in the bending-stroke direction 8 causes a relative movement between the guide roller 47 and guide pin 50 combination and the cam gate 46 provided on the swivel lever 23. Given the shape of the cam gate 46 chosen for the example described, the swivel lever 23 will not initially change its nearly vertical starting position. Instead, there will initially be an approximately straight-line vertical movement between the swivel lever 23 and the metal strip 52. As the swivel-lever tip strikes the bottom side of the metal strip 52, the rim of the metal strip 52 which laterally protrudes at the hold-down 14 and the workpiece support 42 is bent upwardly as seen in FIG. 5.

Figure 6:
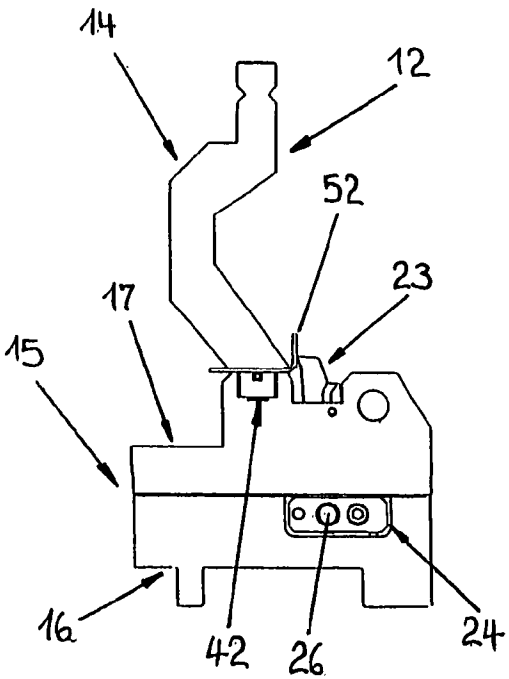
FIGS. 4 to 6 are side elevational views of the bending tool of FIGS. 1 to 3 in various workpiece processing stages.

As the hold-down 14 and upper section 17 of the lower tool 15 are lowered further in the bending-stroke direction 8, the cam gate 46 on the swivel lever 23 interacts with the guide roller 47 and guide pin 50 on the upper section 17 and causes the swivel lever 23 to rotate in a direction which, in the illustrations, is counterclockwise. The swivel-lever tip shifts accordingly, with the rim of the metal strip 52 impacted by it, in the transverse stroke direction toward the hold-down 14. In the process the swivel lever 23 passes through a swivel position in which the bent rim of the metal strip 52 points straight up as seen in FIG. 6. By the end of the downward movement of the hold-down 14 and the upper section 17 of the lower tool 15, the rim of the metal strip 52 will have been bent by the swivel-lever tip past its vertical position and toward the hold-down 14 as seen in FIG. 3. The bottom side of the lower tool 15 now rests on the top side of the tool base 16. This completes the bending stroke and the processing operation resulting in the bending of the metal strip 52.

When the crosshead beam 5 and the hold-down 14 are moved in the return-stroke direction 9, the upper section 17 of the lower tool 15 will initially follow that movement due to the pressure of the prestressed pneumatic spring 36. In this return movement, the guide posts 33, 34 guide the upper section 17 on the tool base 16 of the lower tool 15.

Once the pneumatic spring 36 is fully extended, the continued movement of the crosshead beam 5 and hold-down 14 in the return-stroke direction 9 will cause the hold-down 14 to lift off the bent metal strip 52. The metal strip 52 can now be taken out of the bending tool 12.

Synchronously with the return-stroke movement of the hold-down 14, the guide roller 47 and guide pin 50 on the upper section 17 will lift from the swivel lever 23 and its cam gate 46. As a result, the swivel lever 23 will rotate counterclockwise out of the position shown in FIG. 3 and into its starting position as seen in FIGS. 2, 4 and 7.

The position of the support of the swivel lever 23 on the tool base 16 can be modified to permit compensation for assembly and/or manufacturing tolerances, variation of the travel path of the swivel-lever tip as well as the mutual adjustment of the swivel levers 23 of juxtapositioned bending tools 12. For that purpose, the first step is to loosen the lock screw 29 on the plummer block 24. Next, turning the setscrew 28 allows the adjustment of the rotary position of the plummer block 24 relative to the pivot 27 and thus of the position of the fulcrum pin 26 of the swivel lever 23. The repositioned plummer block 24 is then secured again using the lock screw 29. As can be seen especially in FIGS. 4 to 7, the adjustment mechanism for the plummer block 24 on the bending tool 12 is accessible when the upper section 17 of the lower tool 15 is installed.

However, detaching the upper section 17 takes just a few steps. The first step is to loosen the fasteners 43 by means of which the support element 41 of the workpiece support 42 is held in the groove 40. Next, the support element 41 is removed from the groove 40, permitting access to the mounting of the pneumatic spring 36 in the upper section 17. After that mounting is removed, the upper section 17 can be removed from the tool base 16 as a single structural unit. The guide pin 50 in the upper section 17 can be removed from the guide slot 51 of the swivel lever 23 through the downward opening in the direction of disassembly.

Mounting the upper section 17 on the tool base 16 of the lower tool 15 is just as easy. When the upper section 17 is removed, it is possible to replace the existing swivel lever 23 with its cam gate 46 with another swivel lever and cam gate combination. Changing the cam gate geometry will change the maximum bending angle attainable with the swivel lever concerned. Moreover, using a cam gate with a different gate geometry permits adaptation of the bending tool 12 to different sheet-metal thicknesses and workpiece materials.

Another possibility is to replace the swivel lever 23 shown in the illustrations with a swivel lever that offers a wider swivel-lever tip in the direction of the bending line 13. In particular, it may be desirable to use, instead of the swivel lever 23 illustrated, a swivel lever whose swivel lever tip is flush on its sides with the side walls of the lower tool 15. If several bending tools 12, equipped with such a swivel lever, are lined up in contiguous fashion in the direction of the bending line 13, the result on the lower tools 15 of the bending tools 12 will be a continuous bend in the direction of the bending line 13.

Thus, it can be seen from the foregoing detailed specification and attached drawings that the bending machine of the present invention provides a novel and highly effective bending action.

Having thus described the invention, what is claimed is:

1. A bending tool for bending sheet metal and plate workpieces (52), along a bending line (13), with at least one bending element (23) for positioning on one side of the workpiece and with at least one retaining device having clamping elements (14, 42) on mutually opposite sides in the transverse direction of the workpiece so that relative movement of the clamping elements (14, 42) in the transverse direction of the workpiece permits said workpiece to be clamped to the retaining device, while the retaining device with the clamped workpiece arid a bending element (23) can be moved toward each other in a bending stroke that bends the workpiece, said bending stroke including a component in the stroke direction (8) extending in a transverse direction of the workpiece as well as a component in the cross stroke direction that extends transversely relative to the plane bounded by the direction of the bending line (13) and the said stroke direction (8), a motion control system which controls the direction of the bending stroke, said control system including at least one control element in the form of a link (46) which is operatively connected to the bending element (23), and at least one control element in the form of a link guide (47, 50) which is operatively connected to move concurrently with a clamping element (42) provided on the same side of the workpiece as the bending element (23) and the link guide (47, 50), said link guide (47, 50) consisting of a control roller (47) which is arranged on one side of the link (46) and a control pin (50) which is arranged on the outer side of the link (46), and wherein, the clamping element (42) to which the link guide (47, 50) is operatively connected during the bending stroke to move concurrently therewith, said clamping element (42) being free to move relative to the bending element (23) to which the link (46) is operatively connected to move concurrently therewith, said bending element (23) being stationary and supported in the stroke direction (8) with the control roller (47) and the control pin (50) of the link guide (47, 50) being free to move in the stroke direction (8) relative to the link (46).

2. The bending tool in accordance with claim 1 wherein a bending element (23) and an associated link (46) arc supported on a tool base (16) in the stroke direction (8) and wherein the retaining device with a clamping element (42) and an associated link guide (47, 50) can be moved relative to the bending element (23) and its associated control element (46) supported on the tool base (16) in the stroke direction (8).

3. The bending tool in accordance with claim 1 wherein a clamping element (42) and an associated link guide (47, 50) on the same side of the workpiece are guided on the tool base (16) in the stroke direction (8).

4. The bending tool in accordance with claim 1 wherein a clamping element (42) on one side of the workpiece holds the workpiece in the stroke direction (8) and is movably supported on the tool base (16) in the stroke direction (8) jointly with an associated link guide (47, 50) by a device for generating a restoring force and wherein at least one clamping element (14) of the retaining device bears on the workpiece on its opposite side of the workpiece in the stroke direction (8).

5. The bending tool in accordance with claim 4 wherein the device provided for generating a restoring force is a pneumatic spring (36).

6. The bending tool in accordance with claim 1 wherein there is included a unitary assembly of a clamping element (42) with an associated link guide (47, 50) on the same side of the workpiece.

7. The bending tool in accordance with claim 2 wherein the support for a bending element (23) and its associated link (46) is adjustable in its position on the tool base (16).

8. The bending tool in accordance with claim 2 wherein the support of the bending element (23) and its associated link (46) on the tool base (16) encompasses a plummer block (24) on which the bending element (23) and its associated link (46) are seated and which is positionally adjustable in a mounting an the tool base (16).

9. The bending tool in accordance with claim 1 wherein a betting element (23) is provided in the form of a swivel lever which, in combination with an associated link (46), is supported on the tool base (16) in the stroke direction (8) and, seated on a swivel mount with a pivot that extends in the direction of the bending line (13), so that it can be moved in the cross stoke direction.

10. A bending machine including at least one bending tool (12) in accordance with claim 1.

11. A bending machine in accordance withclaim 10 including a machine base (2) and, provided on the base, tool holders (7, 11) on both sides of a workpiece to be processed, said machine base (2) being comprised of the machine base of a bending press with tool holders (7, 11) which can move relative to one another in controlled fashion in the transverse direction of the workpiece to be processed, and the tool holder (7) on one side of the workpiece holding at least one bending element (23) with at least one associated link (46) as well as at least one of the clamping elements (14, 42) of the retaining device, at least on the clamping elements (14. 42) with at least one associated link guide (47, 50) while at least another one of the clamping elements (14, 42) of the retaining device is positioned in the tool holder (11) on the other side of the workpiece.

* * * * *